United States Patent [19]

Honma et al.

[11] Patent Number: 5,040,405

[45] Date of Patent: Aug. 20, 1991

[54] TUBE EXPANDER

[75] Inventors: Kensaku Honma; Masahide Sakaguchi, both of Tokyo, Japan

[73] Assignee: Hidaka Seiki Kabushiki Kaisha, Tokyo, Japan

[21] Appl. No.: 606,932

[22] Filed: Oct. 31, 1990

[30] Foreign Application Priority Data

Dec. 7, 1989 [JP] Japan ..... 1-318520

[51] Int. Cl.[5] ..... B21D 31/04; B21D 37/04

[52] U.S. Cl. ..... 72/462; 72/481; 29/727; 29/890.44

[58] Field of Search ..... 29/727, 890.44; 72/481, 72/462, 75, 368, 370, 373, 479

[56] References Cited

U.S. PATENT DOCUMENTS

| | | | |
|---|---|---|---|
| 3,824,668 | 7/1974 | Wightman | 29/727 |
| 4,738,130 | 4/1988 | Homma | 72/481 |
| 4,771,536 | 9/1988 | Vanderlaan et al. | 29/727 |

FOREIGN PATENT DOCUMENTS

| | | | |
|---|---|---|---|
| 29745 | 6/1981 | European Pat. Off. | 29/727 |
| 0016213 | 3/1989 | Japan . | |

*Primary Examiner*—David Jones

*Attorney, Agent, or Firm*—Birch, Stewart, Kolasch & Birch

[57] ABSTRACT

The present invention relates to a tube expander having a reciprocating member for selectively reciprocating a plurality of mandrels for expanding tubes. Each mandrel includes a bullet, having a diameter which is larger than the inner diameter of the tubes, at the one end thereof. The tube expander of the present invention comprises an engage section formed at a head section of the mandrel, the diameter of the engage section is larger than the shaft section of the mandrel. A fixture is provided with the reciprocating member and having a through-hole through which the shaft section of the mandrel is inserted. A stopper is provided on the rear face of the fixture and being independently moved with respect to the head section of the mandrel by a drive means. The stopper prevents the mandrel from moving in the axial direction thereof with respect to the fixture during the movement of the stopper.

6 Claims, 4 Drawing Sheets

TUBE EXPANDER

FIELD OF THE INVENTION

The present invention relates to a tube expander, more specifically relates to a tube expander for expanding tubes of heat exchangers which are used for cars, home electric appliances, etc.

DESCRIPTION OF BACKGROUND ART

The tubes and a fin-plate of a heat exchanger are united in one body by inserting the tubes through holes bored in the fin-plate and by expanding the tubes.

An example of a conventional tube expander for expanding the tubes is shown in FIG. 3. The tube expander in FIG. 3 has a reciprocating member 1, which is reciprocally moved up and down along guide shafts 5 and 5 by oil hydraulic cylinders 4 and 4, and multiple mandrels 41, each of which has a bullet having diameter which is larger than the inner diameter of the tube 50 which will be expanded and which is formed at the lower end thereof.

The lower end of each mandrel 41 is inserted into a corresponding tube 50, which is positioned below the lower end of each mandrel 41, to expand with the descending of the reciprocating member 1.

In the conventional tube expander, mandrels 41 are manually attached to or detached from the reciprocating member 1 according to the number or the arrangement of the tubes 50.

When mandrels 41 are attached or detached, the expanding work should be stopped. Thus, the efficiency of the work is reduced. Further, many types or many shapes of coolers presently exist, so that the number and the arrangement of the tubes 50 should be adapted to the coolers. Therefore, the efficiency of the expanding work is quite low because the attaching and the detaching are frequently requested during the expanding work.

To solve the above noted disadvantages, a tube expander, which is not required to attach and to detach mandrels when the number and the arrangement of tubes are changed, is disclosed in Japanese Patent Publication No. 1-16213. As illustrated in FIG. 4, a fixture 6 of mandrels 41 is provided on a reciprocating member 1 of the tube expander. There are bored through-holes through which the mandrels 41 are inserted in the fixture 6. The head sections of the mandrels 41 can project upward from the upper face of the fixture 6 but they are engaged so as not to move downward. Further, a plate 53 having multiple holes 52 is assembled on the upper face of the fixture 6. Further, a plate having multiple holes 52 shown in FIG. 6 is assembled on the upper face of the fixture 6.

In this expander, the head sections of the mandrels 41 corresponding to the holes 52 are not pressed by the plate 53, so that they project upward from the holes 52. More specifically the mandrels 41 corresponding to the holes 52 are not used for expanding tubes. If the pattern of holes, which is designed to press specific head sections of the mandrels 41 for expanding tubes, is defined beforehand, only the specific mandrels 41 which are needed will be moved downward. If plates 53, which individually have different patterns of holes 52, are prepared and set in a cartridge 26, the plate 53 having a desired pattern can be assembled on the upper face of the fixture 6 by an arm 33, which is moved in the right-left direction and is rotated by an oil hydraulic cylinder 30, etc. Note that, the up-down movement of the cartridge 26 is executed by a rod 28 of an oil hydraulic cylinder.

In the tube expander disclosed in Japanese Patent Publication No. 1-16213, once the maximum number of mandrels are attached to the fixture, it is not necessary to attach and detach the mandrels even if the number and the arrangement of the tubes of the heat exchanger are changed. Thus, the efficiency of the tube-expanding work can be increased.

However, in the above-described tube expander, it is necessary to prepare plates for the desired patterns. Therefore, if a plate having the desired pattern is not prepared, mandrels should be manually attached or detached, so that the efficiency will be quite low. Further, it is necessary to precisely make the plates because the locations of the mandrels, having head sections projecting upward from the fixture, must coincide with the locations of the holes.

SUMMARY OF THE INVENTION

The present invention controls the upward projection of the head sections of the mandrels with respect to the upper face of the fixture so as to solve the above noted disadvantages of the conventional tube expander.

The present invention is directed to a tube expander comprising a reciprocating member for reciprocating a mandrel, which includes a bullet having a diameter which is larger than the inner diameter of a tube which will be expanded at one end thereof. An engage section is formed at a head section of the mandrel, the diameter of the engage section is larger than the shaft section of the mandrel. A fixture is provided having a reciprocating member and having a through-hole through which the shaft section of the mandrel is inserted. A stopper is provided on the rear face of the fixture and is independently moved with respect to the head section of the mandrel. A drive member is provided for driving the stopper provided in the vicinity of the through-hole on the fixture.

In the tube expander of the present invention, each stopper, provided on the rear face of the fixture, is independently moved with respect to each mandrel by the drive means provided in the vicinity of each through-hole through which the shaft section of the mandrel is inserted. Therefore, the only stoppers corresponding to specific mandrels for expanding tubes can be moved to prevent the axial movement of the mandrels. Thus, the desired mandrels can be used for expanding tubes without preparing pattern plates. Further, during the expanding work, it is possible to quickly select mandrels pressed according to the number and the arrangement of the tubes which will be expanded without changing the pattern plates.

BRIEF DESCRIPTION OF THE DRAWINGS

The present invention will become more fully understood from the detailed description given hereinbelow and the accompanying drawings which are given by way of illustration only, and thus are not limitative of the present invention and wherein:

FIG. 1(*b*) shows a sectional view taken along line 1(*b*)—1(*b*) of FIG. 1(*a*);

DETAILED DESCRIPTION OF PREFERRED EMBODIMENT

The present invention will now be described in detail with reference to the accompanying drawings.

Figure 1:
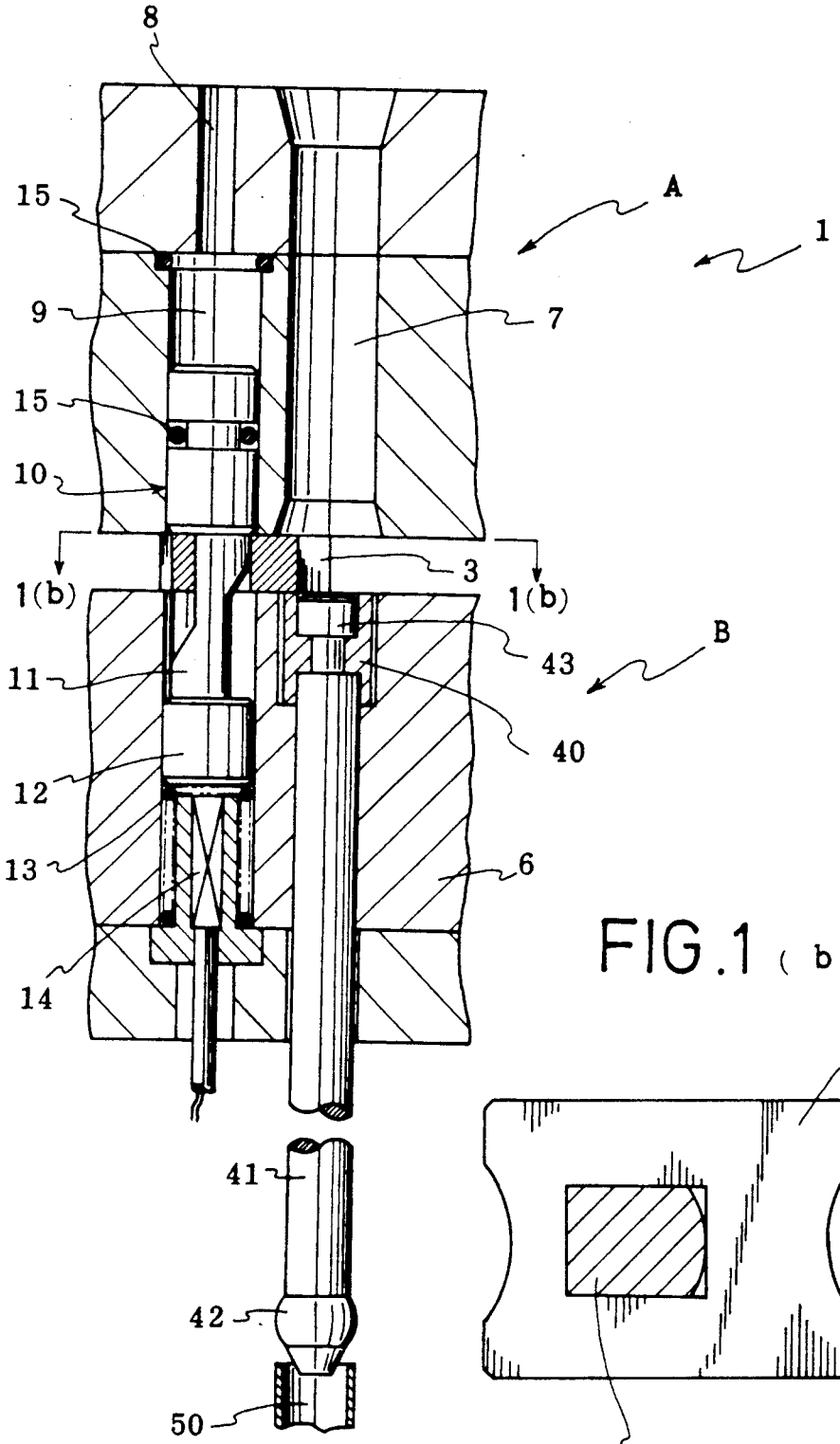
FIGS. 1(*a*) and 2(*a*) show partial sectional views of a front portion of an embodiment of the present invention.
Figure 1:
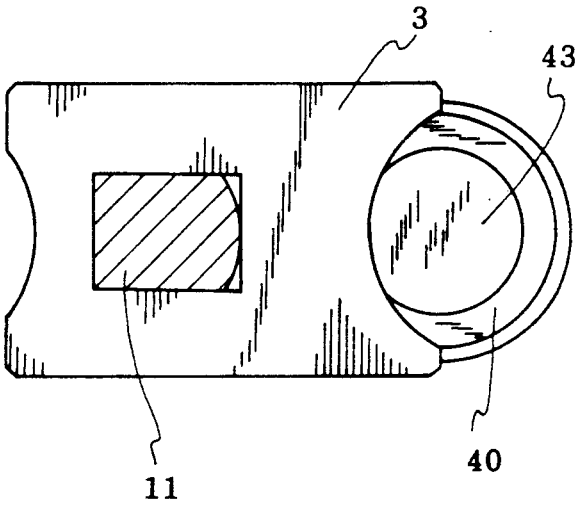
Figure 3:
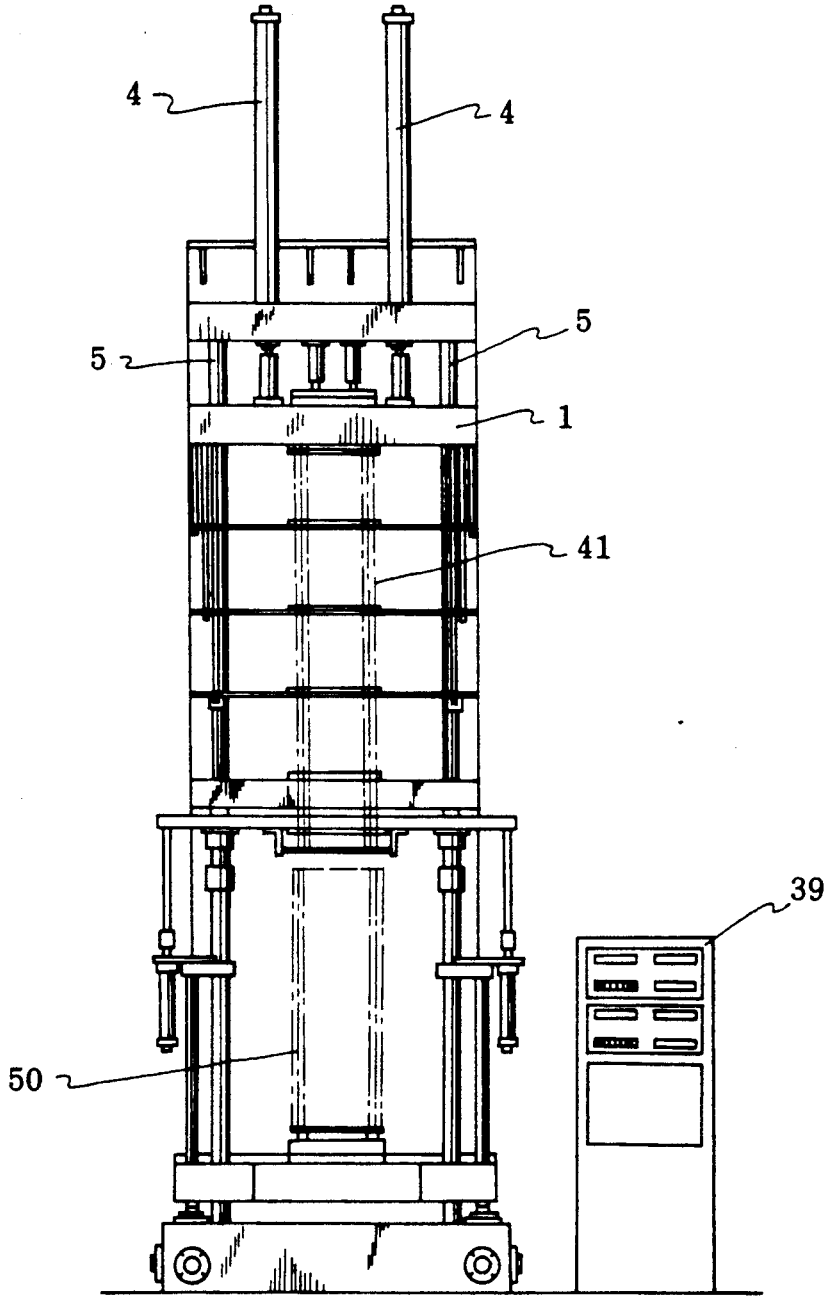
FIG. 3 PRIOR ART
FIG. 3 shows a conventional tube expander.
Figure 4:
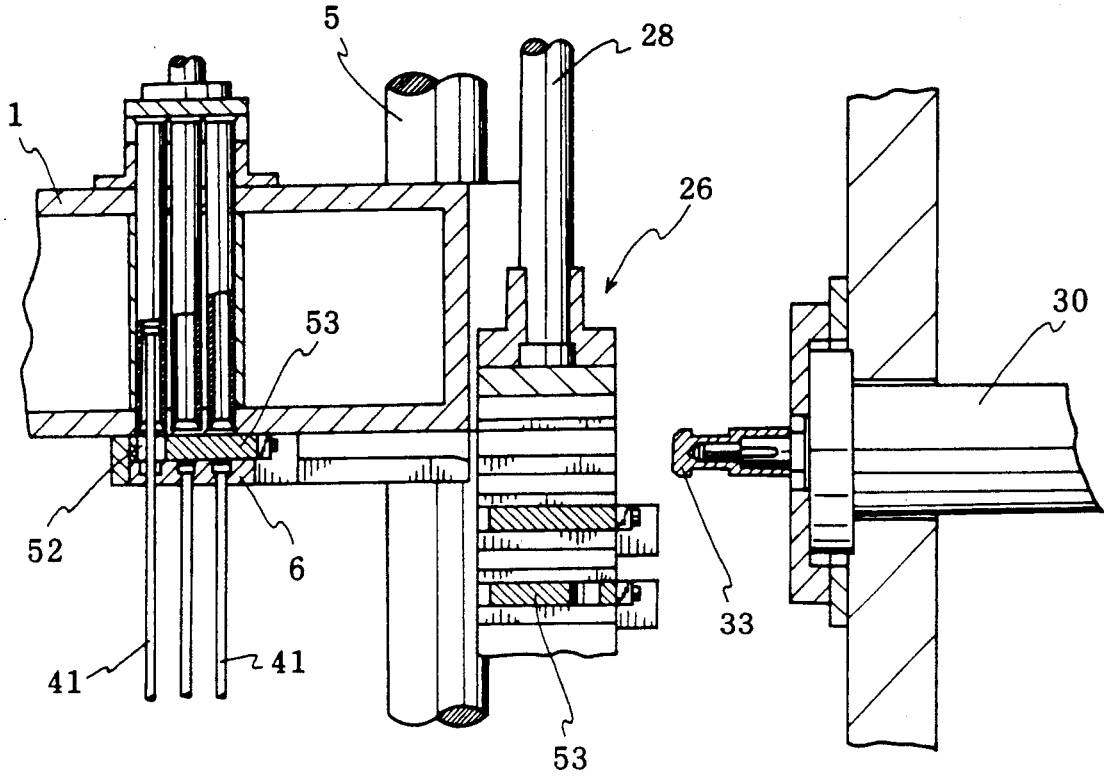
FIG. 4 PRIOR ART
FIG. 4 shows a partial sectional view of a conventional tube expander.
Figure 5:
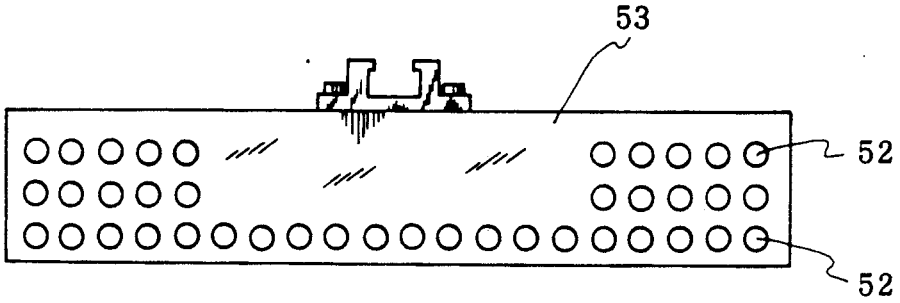
FIG. 5 PRIOR ART
FIG. 5 shows a plan view of a pattern plate for a conventional tube expander as illustrated in FIG. 4.

FIG. 1(*a*) shows a sectional view of an embodiment of the present invention. A reciprocating member 1 is moved along guide shafts 5 and 5 in the up and down direction by oil hydraulic cylinders 4 and 4 as shown in FIG. 3. Note that, the operating status of the oil hydraulic cylinders 4 and 4, etc. are shown in a display unit 39 (see FIG. 3).

The reciprocating member 1 is composed of an upper pattern plate A and a lower pattern plate B to which a fixture 6 is attached.

A plurality of through-holes are bored in the fixture 6 and each shaft section of the mandrel 41 is inserted therethrough.

A bullet 42 whose diameter is larger than the inner diameter of a tube 50 which will be expanded is formed at one end of each mandrel 41 and is inserted through the through-hole. The head section 43 has an engage step 40 having a diameter which is larger than the diameter of the shaft section of the mandrel 41. The engage step 40 of the head section 43 of the mandrel 41 is engaged with a cylindrical holding section, which is formed at an opening on the upper side of the fixture 6 so as to prevent the mandrel 41 from moving downward. However, the engage step 40 of the mandrel 41 can project upward from the upper face of the fixture 6. In addition, a through-hole 7 corresponding to the mandrel 41 is bored in the upper pattern plate A, so that the engage step 40 can project into the through-hole 7.

In the present invention, there is provided a stopper 3 between the upper pattern plate A and the lower pattern plate B. The stopper 3 is a flattened plate as shown in FIG. 1(*b*) which is a view taken in the direction of arrows 1(*b*)—1(*b*) in FIG. 1(*a*). Also the stopper 3 is a grooved plate with arc-notches at the both ends along the minor axis thereof.

A rod 11 of a piston-cam 10 is inserted through the stopper 3. The piston-cam 10 is provided in the vicinity of the through-hole 7 through which the shaft section of the mandrel 41 extends. The piston-com 10 is located in a hole 9 which is bored in the upper pattern plate A and the lower pattern plate B. The piston-cam 10 is biased upward by a spring 13 which is provided in the bottom of the hole 9 and exerts a force against a guide 12. The piston-cam 10 is moved downward against the elasticity of the spring 13 by compressed air introduced through an air hole 8 of the upper pattern plate A through which compressed air is introduced. Note that, 0 rings 15 and 15 are mounted on the piston-cam 10 and adjacent to the entrance to the hole 9 so as to prevent leakage of compressed air.

The upper section and the lower section of the rod 11 of the piston-cam 10 mutually project in opposite directions. With this structure, the stopper 3, which covers over the rod 11, can be moved in opposite directions in a plane perpendicular to the axial direction of the mandrel 41 by the up and down movement of the rod 11. The piston-cam 10 and the stopper 3 are provided adjacent to each mandrel attached to the fixture 6.

In the tube expander of the above-described embodiment, there is provided a sensor 14, e.g. a micro switch, mounted adjacent to the bottom of the hole 9. The sensor 14 generates a signal for driving the display unit 39 (see FIG. 3) when the guide 12, which is pressed downward by compressed air introduced through the air hole 8, contacts the sensor 14.

The position wherein the sensor 14 is generating the signal for driving the display unit 39 is shown in FIG. 1(*a*). In this position, the piston-cam 10 has moved downward and the rod 11 has forced the stopper 3 to move toward the mandrel 41 (to the right in the drawing) so as to cover over the head section 43 of the mandrel 41 and a part of the upper face of the engage step 40. With this covering, the mandrel 41 moves up and down with the up-down movement of the reciprocating member 1, so that the bullet 42 of the mandrel 41 can penetrate into the tube 50 to expand the tube.

The upward projection of the mandrel 41 with respect to the fixture 6 is fully prevented by covering over the head section 43 of the mandrel 41 and a part of the upper face of the engage step 40 with the stopper 3 as shown in FIG. 1(*b*). If the stopper 3 is to cover over the head section 43 of the mandrel 41 and the whole upper face of the engage step 40, the structure is at a disadvantage with respect to space requirements because the stroke of the movement of the stopper 3 must be longer.

Figure 2:
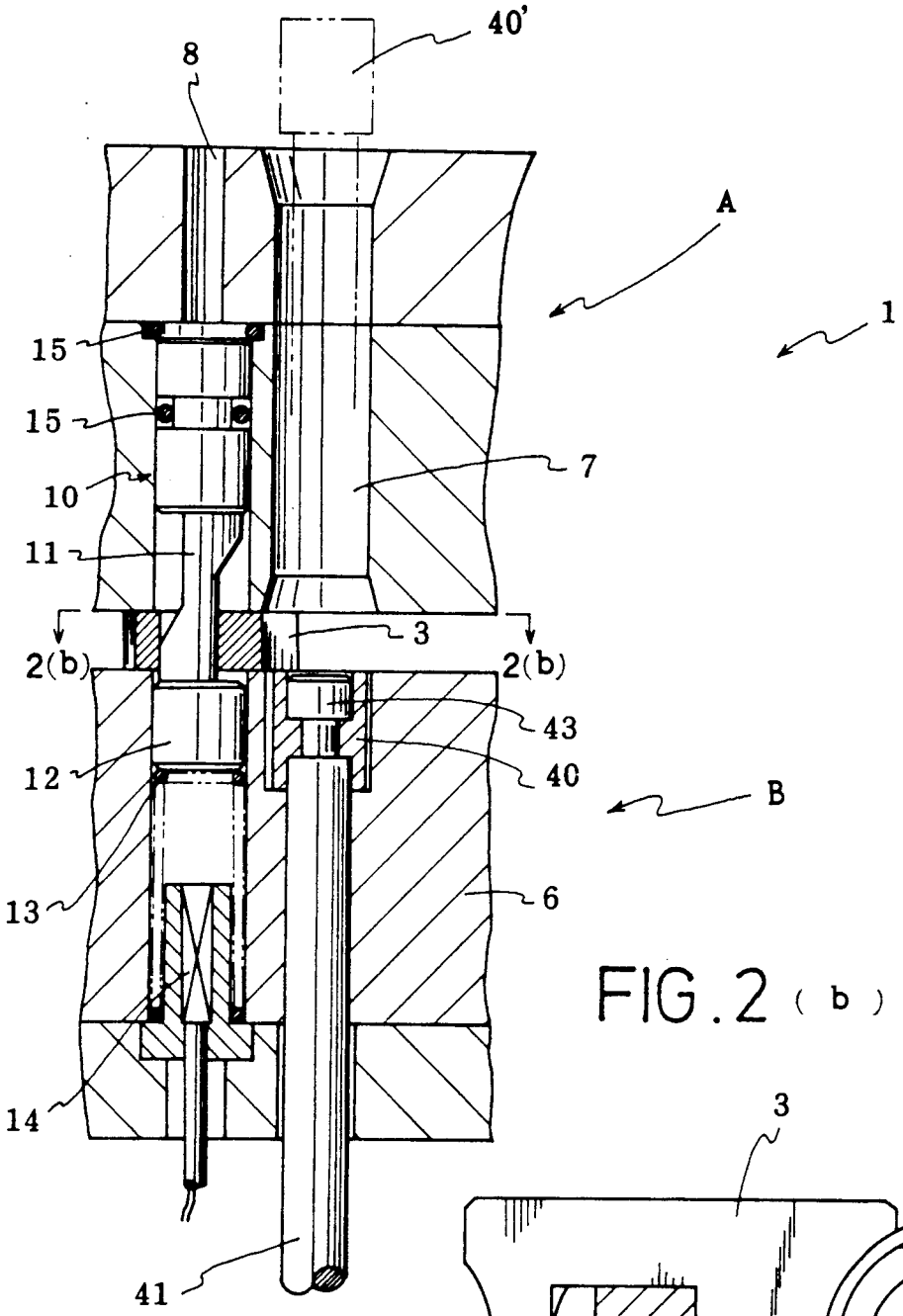
FIG. 2(*b*) shows a sectional view taken along line 2(*b*)—2(*b*) of FIG. 2(*a*)
Figure 2:
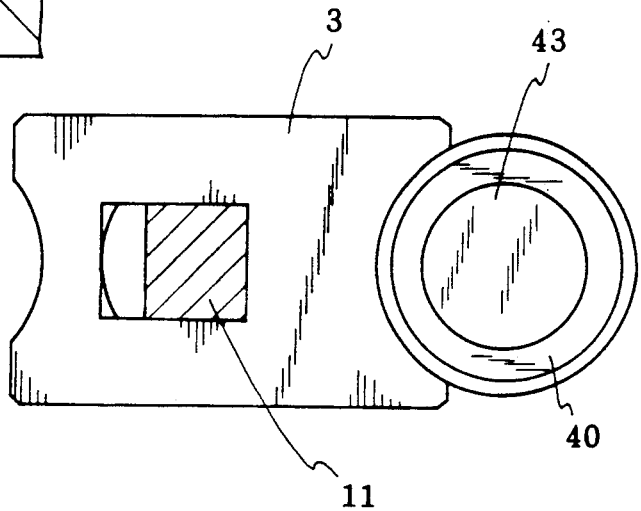

When compressed air introduced to the hole 9 via the air hole 8 is discharged, the piston-cam 10 is moved upward by the spring 13 as shown in FIG. 2(*a*). At this time the stopper is moved away from the mandrel 41 (to the left in the drawing) by the rod 11, so that the head section 43 of the mandrel 41 and the portion of the upper face of the engage step 40 are released.

When the reciprocating member 1 moves downward, the head section 43 of the mandrel 41 and the engage step 40 extend into the through-hole 7 bored in the upper pattern plate A as illustrated by the engage step 40' in FIG. 2(*a*). Therefore, the bullet 42 of the mandrel 41 cannot move downward with the reciprocating member 1, and the tube 50 is not expanded.

In this embodiment, the piston-cam 10 and the stopper 3 are provided adjacent to each mandrel attached to the fixture 6, so that only selected mandrels 41 corresponding to tubes which will be expanded can be moved downward with the reciprocating member 1. Further, the selection of the mandrels can be quickly executed by supplying compressed air without preparing pattern plates in which desired patterns are formed and thereafter changing the pattern plates. If the arrangement of the mandrels attached to the fixture 6 is shown in the display unit 39, the expanding pattern of the mandrels can be quickly indicated by the signal of the sensor 14. Note that, the piston-cam 10 is driven by compressed air in this embodiment. However, the piston-cam 10 can also be driven by oil pressure.

In the tube expander of the present invention, if the arrangement of tubes of a heat exchanger is changed, it is not necessary to prepare and change the pattern plates. Thus, a quick change over for work can be executed. Therefore, many types of heat exchangers can be efficiently manufactured.

We claim:

1. A tube expander for expanding a desired number of tubes comprising a mandrel, a reciprocating member for reciprocating said mandrel, said mandrel having a head section and a shaft section, said shaft section including a bullet at one end thereof having a diameter larger than an inner diameter of a tube which is to be expanded by said bullet, wherein the improvement comprises, an engage step formed at said head section of said mandrel, the diameter of said engage step being larger than said shaft section of said mandrel, said reciprocating member including a fixture having a through-hole through which the shaft section of said mandrel is inserted, a rear face disposed on one side of said fixture, a stopper having an opening therethrough being provided on said rear face of said fixture and being independently moved in back and forth directions with respect to said head section of said mandrel, said stopper having a face substantially parallel to said rear face of said fixture and positionable to engage said head section, drive means for driving said stopper provided adjacent the through-hole of said fixture for selectively engaging and disengaging said stopper with said head section of said mandrel, said drive means includes a rod movably inserted through said opening in said stopper in a direction perpendicular to said stopper face, and projecting sections are respectively formed at both ends of said rod, said projecting sections projecting with respect to an axis of said rod in opposite directions which are said directions of the movement of said stopper.

2. A tube expander according to claim 1, wherein said stopper is a flattened plate, having one end face on said mandrel side formed to correspond to an outer shape of said engage step located at the head section of said mandrel.

3. A tube expander according to claim 1, wherein a hole in which said drive means is inserted is bored in said fixture substantially parallel to the through-hole of said fixture, and further comprising:

a sensor for detecting the movement of said drive means provided within the hole; and a display unit for indicating the operation of said drive means being responsive to a signal from said sensor.

4. A tube expander according to claim 1, wherein actuating said drive means to impart movement to said stopper to engage said head section enables said mandrel to be reciprocated together with said reciprocating member.

5. A tube expander according to claim 1, wherein deactuating said drive means for returning said stopper to an inoperative position disengages said stopper from said head section for enabling said mandrel to move into said through-hole for not reciprocating together with said reciprocating member.

6. A tube expander according to claim 1, further including biasing means located in said fixture for normally biasing said drive means to a deactuated position.

* * * * *